US005433081A

United States Patent [19]

Major et al.

[11] Patent Number: 5,433,081

[45] Date of Patent: Jul. 18, 1995

[54] REFRIGERANT RECOVERY AND PURIFICATION METHOD AND APPARATUS WITH OIL ADSORBENT SEPARATOR

[76] Inventors: Thomas O. Major, 4105 Gray, Denver, Colo. 80212; Jack E. Major, Jr., 1590 Harlan, Lakewood, Colo. 80214

[21] Appl. No.: 7,210

[22] Filed: Jan. 22, 1993

[51] Int. Cl.[6] ..... F25B 47/00

[52] U.S. Cl. ..... 62/85; 62/475; 62/292

[58] Field of Search ..... 62/292, 470, 474, 475, 62/77, 85

[56] References Cited

U.S. PATENT DOCUMENTS

| | | | |
|---|---|---|---|
| 2,875,592 | 3/1959 | Olsen | 62/470 |
| 3,520,149 | 7/1970 | Uratani | 62/470 |
| 4,981,020 | 1/1991 | Scuderi | 62/77 |
| 5,182,918 | 2/1993 | Manz et al. | 62/149 |
| 5,193,358 | 3/1993 | Winther | 62/470 |
| 5,502,177 | 4/1993 | Manz et al. | 62/292 |

FOREIGN PATENT DOCUMENTS 4-013069 1/1992 Japan .

*Primary Examiner*—John M. Sollecito
*Attorney, Agent, or Firm*—J. Preston Oxenham

[57] ABSTRACT

A refrigerant purification and recovery apparatus for removing refrigerant from a refrigeration unit and purifying the refrigerant includes refrigerant phase separation means for dividing a fluid refrigerant stream into a liquid phase and a gaseous phase stream, means for converting the liquid stream into a substantially gaseous stream and means for purifying the gaseous refrigerant stream including an oil polisher having a canister containing a porous, oleophilic, oil adsorbent material through which the refrigerant stream must pass.

9 Claims, 7 Drawing Sheets

REFRIGERANT RECOVERY AND PURIFICATION METHOD AND APPARATUS WITH OIL ADSORBENT SEPARATOR

TECHNICAL FIELD

The present invention relates to apparatus for recovery and purification of refrigerant charges contained in refrigerating systems. More particularly, the present invention relates to apparatus for recovering refrigerant from a refrigerating system prior to repair or replacement of the refrigerating system and purifying the charge for reuse in that or another system.

BACKGROUND OF THE INVENTION

Traditionally, when refrigerant charged refrigeration systems were repaired, the refrigerant charge was simply loosed to the atmosphere as necessary to accomplish the repairs. In recent times, it has become increasingly desirable to capture and reuse the refrigerant charges for a number of reasons; refrigerant pollution of the atmosphere is perceived as environmentally destructive, government regulations now limit the release of fluorocarbon refrigerants to the atmosphere, and the cost of refrigerant materials has increased making the disposal and replacement of the refrigerant charge increasingly costly.

Refrigerant recovery devices of the prior art have compressed and cooled refrigerant from charged systems to a liquid state for storage and reintroduction to the same system after repair has been accomplished or for use in other systems. Many of these prior art recovery systems have employed filtration of the refrigerant during the removal-compression-cooling process to remove contaminants from the used refrigerant. However, in today's political climate of increasing environmental concern, many of these systems fail to purify used refrigerants sufficiently to meet standards of proposed and existing environmental regulations. Purification elements by many of the systems of the prior art become contaminated by refrigerant impurities remaining in the apparatus from previous recovery operations or with lubricants which migrate from the compressor when the apparatus is tilted during transport. Also, under certain conditions of sufficiently high refrigerant pressure and cool ambient temperatures, some of the prior art systems are susceptible to entry of liquid refrigerant into the suction side of the recovery system compressor which may cause damage to the compressor and power components of the recovery system. Further, many of the prior art systems may operate satisfactorily only in a limited range of ambient temperature and cannot effectively remove energy from the compressed refrigerant to assure its complete liquefaction prior to its injection into a storage container when ambient temperatures are high.

DISCLOSURE OF THE INVENTION

It is an object of the present invention to provide an economic and effective refrigerant recovery and purification system for recovering and purifying refrigerant charges of refrigeration systems for reintroduction to the same refrigeration system or use in another refrigeration system.

It is also an object of the present invention to provide a refrigerant purification system which will effectively purify used refrigerant by removing contaminants including oil, acid, water and "noncompressible" gases from recovered refrigerant in a systematic and economic manner.

It is an additional object of the present invention to maximize the effectiveness of purification elements, including filtering media, and economy and versatility of operation of recovery and purification apparatus by effective energy management within the recovery and purification apparatus.

It is a further object of the present invention to utilize methods of refrigerant purification which may be adapted to an automated system or accomplished with operator observation and interaction with the recovery and purification apparatus.

It is yet a further object of the present invention to provide a refrigerant recovery and purification apparatus which may be transported without undue risk of contaminating purification elements with refrigerant contaminants remaining in the apparatus from previous recovery operations or with lubricants resident in the apparatus necessary for proper operation of the apparatus.

It is another object of the present invention to maximize effectiveness of utilization of filtration media in the apparatus while assuring such media are not employed beyond their ability to continue to remove and retain contaminants.

It is also an object of the present invention to provide an apparatus for refrigerant recovery and purification which will not be subject to compressor damage due to introduction of liquid phase refrigerant into the recovery apparatus.

It is an object of the present invention to provide a refrigerant recovery and purification system which is adaptable to effectively reduce recovered refrigerant to a liquid phase for storage under a wide range of ambient temperatures.

In accordance with these objectives, a refrigerant purification and recovery apparatus comprising the present invention includes a phase separator including a separator vessel into which fluid refrigerant from a charged refrigerant system initially flows through an inlet port. The vessel is provided with an upper gas port and a lower liquid port, each equipped with a solenoid valve. A liquid sensing control circuit allows gaseous refrigerant to flow through the upper valve and directly into a gaseous refrigerant purification course except when the level of liquid refrigerant in the vessel is above a predetermined level. When the level of liquid refrigerant in the vessel is above the predetermined level, the upper valve is closed and the lower valve opened to allow liquid to flow through the lower valve to be throttled through a temperature expansion valve, or metering device, and warmed by heat exchange with the ambient atmosphere and gaseous refrigerant stream to become substantially gasified before flowing into the gaseous refrigerant purification course. A heating element may be provided to warm refrigerant within the separator vessel.

The gaseous refrigerant purification course of an embodiment of the present invention includes a first and a second stage oil removal element. The first stage oil removal element includes a canister with an entry port, an exhaust port in an upper extremely, and a drain port in a lower extremely. A plug of porous, heat conducting material blocks the exhaust port and provides a surface upon which oil entrained in the refrigerant stream may coalesce. A heating element warms oil which accumulates in the lower extremely to minimize solution of refrigerant in the collected oil. The second stage oil removal element includes a canister with an entry port, an exhaust port in an upper extremely, a drain port in a lower extremely, and a plug of porous, heat conducting material blocking the exhaust port to provide a surface upon which oil entrained in the refrigerant stream may coalesce.

The gaseous refrigerant purification course of an embodiment of the present invention also includes a first oil polisher having a canister containing a filtration element of oleophilic sorbent material and an acid filter through which the gaseous refrigerant stream must pass. After passing through the first and second stage oil separators, first oil polisher and acid filter, the gaseous refrigerant stream enters a compressor. After compression, the gaseous stream passes through a hot gas oil trap, having a heat conductive surface upon which entrained oil can coalesce, and a second oil polisher, having an oleophilic filtration element, to remove any oil picked up by the gaseous refrigerant stream while passing through the compressor. The gaseous stream then passes through a condenser, in which it is cooled by heat exchange with the ambient atmosphere, and enters a receiver-separator vessel from which noncompressible gasses are vented to the atmosphere. Liquid refrigerant is drawn from a lower portion of the receiver separator vessel to pass through moisture and particulate filters and into a refrigerant storage canister.

A preferred embodiment includes a fan to augment heat exchange between refrigerant in the condenser and the atmosphere when a temperature within a cabinet of the recovery device exceeds a predetermined temperature or a pressure downstream of the temperature expansion valve exceeds a predetermined pressure. A preferred embodiment further includes a cumulative flow meter and a filter element change signaling device to signal when cumulative flow through the recovery device exceeds a predetermined cumulative flow after which filter elements of the apparatus should be replaced to assure proper filtration performance. The preferred embodiment may also include a filter cap sensor to reset the cumulative flow meter when filter cores are removed and replaced so that a signal will be given again after a predetermined cumulative flow has passed through the replacement filter elements. The predetermined cumulative flow amount may be selected based upon the expected level of contamination of the refrigerant being processed as reflected by the frequency at which oil is drained from an oil removal element of the apparatus.

From the above description, it will be seen that the refrigerant purification and recovery method for removing refrigerant from a refrigeration unit and for purifying the refrigerant removed from the refrigeration unit utilized by the present invention includes drawing a stream of fluid refrigerant from the refrigeration unit; separating liquid phase refrigerant from the fluid refrigerant stream; throttling and warming the liquid refrigerant to a substantially gaseous state; reintroducing the substantially gasified liquid refrigerant to the fluid refrigerant stream so that the stream is substantially gaseous; bringing the gaseous refrigerant stream into contact with a relatively cool, heat conducting surface to cause oil entrained in the gas to coalesce on the surface; passing the gaseous refrigerant stream through a porous, oleophilic sorbent material; passing the gaseous refrigerant through an acid filter; compressing the gaseous refrigerant stream; bringing the compressed refrigerant stream into contact with a relatively cool, heat conducting surface to cause oil entrained in the refrigerant to coalesce on the surface; passing the compressed refrigerant stream through a porous, oleophilic sorbent material; cooling the compressed refrigerant stream to substantially liquify the refrigerant stream; passing the liquified refrigerant stream through a receiver separator vessel and venting the vessel to remove noncompressible gasses from the stream; passing the liquified refrigerant stream through a liquid moisture filter to remove moisture from the stream; and, passing the liquid refrigerant through a particulate filter.

Other objects, advantages and aspects of the invention will become apparent upon reading of the following detailed description and claims and upon reference to the accompanying drawings.

DETAILED DESCRIPTION OF THE INVENTION

Figure 1:
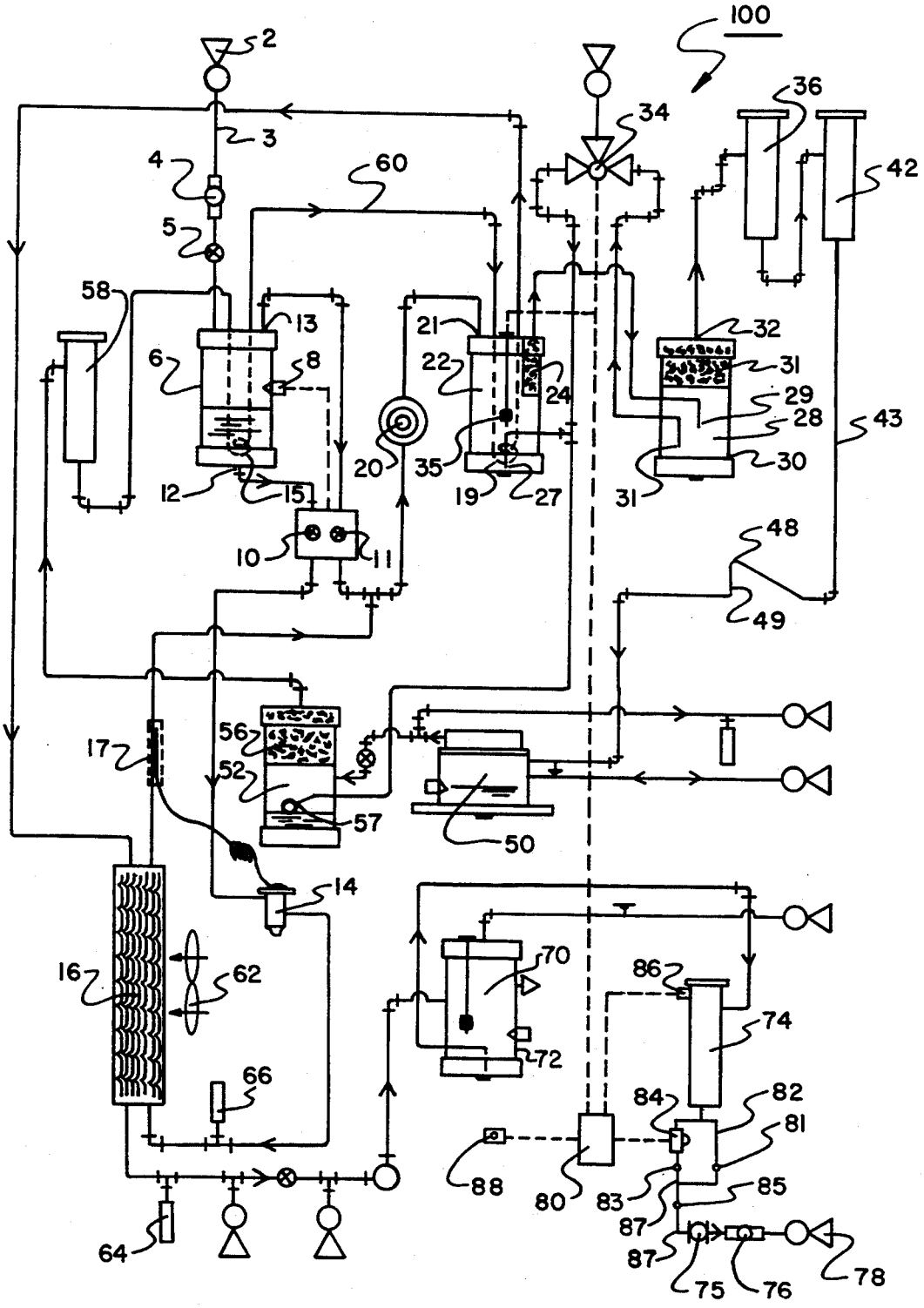
FIG. 1 is a schematic drawing of a refrigerant purification and recovery apparatus comprising a preferred embodiment of the present invention.

Refrigerant purification and recovery apparatus 100 comprising an exemplary preferred embodiment of the present invention is shown schematically in FIG. 1. When refrigerant purification and recovery apparatus 100 is in use, inlet 2 is connected in fluid communication with the fluid circuit of a refrigeration unit from which the refrigerant is to be removed by utilizing a fluid conduit, such as a suction hose, adapted for connection to a connector provided on the refrigeration unit, generally near the suction side of the refrigerant unit compressor. When the recovery-purification process is begun by opening an outlet valve on the refrigeration unit and providing power to compressor 50 of recovery-purification apparatus 100, refrigerant is drawn from the refrigeration unit through inlet 2, conduit 3, particulate filter 4, solenoid valve 5 and into phase separator vessel 6.

Flow of refrigerant from separator vessel 6 is controlled by solenoid valves 10 and 11 in accordance with signals generated by liquid level sensor 8, which may be, for example, a float type sensor or a photoelectric sensor. Normally, when a presence of liquid refrigerant is detected by sensor 8, valve 10 is in an open position while valve 11 is closed, such that liquid refrigerant flows from separator vessel 6 through lower outlet 12 and valve 10, is throttled through temperature expansion valve 14, and flows through an evaporator core of condenser-evaporator 16 to be warmed by heat exchange with the ambient atmosphere such that the flow becomes substantially of gaseous phase before it is introduced into conduit 18. Temperature expansion valve 14 is controlled by gas thermometer 17 located just downstream of evaporator-condenser 16. As gas thermometer 17 detects a temperature of the refrigerant flow downstream of the evaporator core of evaporator-condenser 16 which is indicative of two-phase flow, for example, a temperature of less than or equal to 32 degrees Fahrenheit, temperature expansion valve 14 is closed down to increase the pressure drop over valve 14 and reduce flow volume and pressure to assure the flow downstream of the evaporator core of evaporator-condenser 16 is substantially of gas phase.

When a presence of liquid refrigerant is not detected by sensor 8, valve 10 is placed in a closed position while valve 11 is placed in an open position, such that gaseous refrigerant flows from separator vessel 6 through upper outlet 13 and valve 11 into conduit 18. Warming element 15, described in greater detail below, is included in the bottom of separator vessel 6 to warm the refrigerant within vessel 6 to maintain sufficient vapor pressure of refrigerant within the vessel. Gas phase refrigerant flows from conduit 18, through compressor pressure regulator valve 20 and into first stage oil removal element 22 through inlet port 21. Compressor pressure regulator valve 20 assures pressure downstream of valve 20 does not exceed a specified pressure, for example, 40 psi, to assure refrigerant flow just downstream of valve 20 is of substantially gaseous phase.

Figure 3:
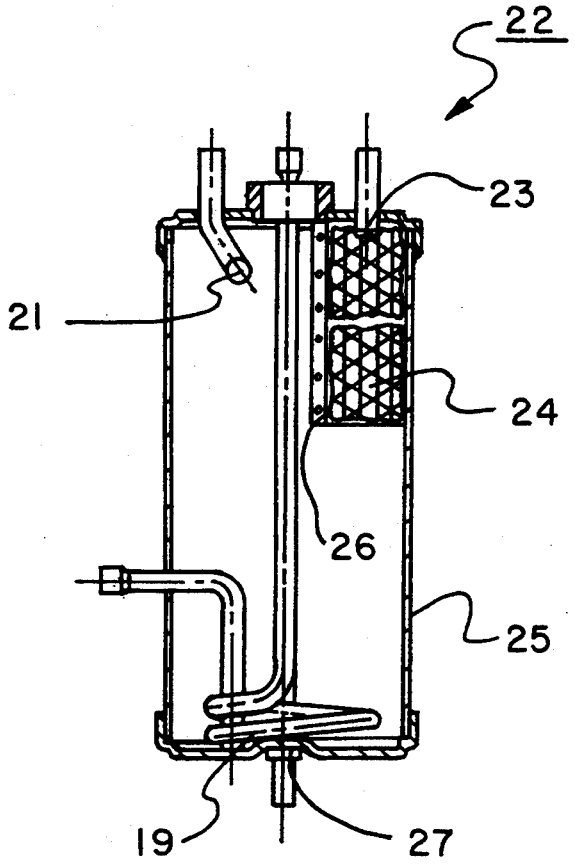
FIG. 3 is a sectional drawing of a first stage oil removal element of a refrigerant purification and recovery apparatus comprising a preferred embodiment of the present invention.

As may best be seen in FIG. 3, first stage oil removal element 22 includes first separator canister 25 and porous plug 24 which is preferably fabricated of heat conductive material, for example, a pad of copper plated steel mesh material. The gaseous refrigerant must flow through plug 24 to escape canister 25 through outlet port 23 and oil entrained in the gaseous refrigerant flow will coalesce on the plug material surface, flow to the bottom of canister 25 and accumulate together with oil which may flow as plugs through inlet 21 into canister 25. In the preferred embodiment of FIG. 3, plug 24 is contained in a chamber formed between chordal baffle 26 and the wall of canister 25. Warming element 19, described in greater detail below, is included in the bottom of canister 25 to warm the accumulated oil and drive out refrigerant which may be dissolved therein.

Figure 4:
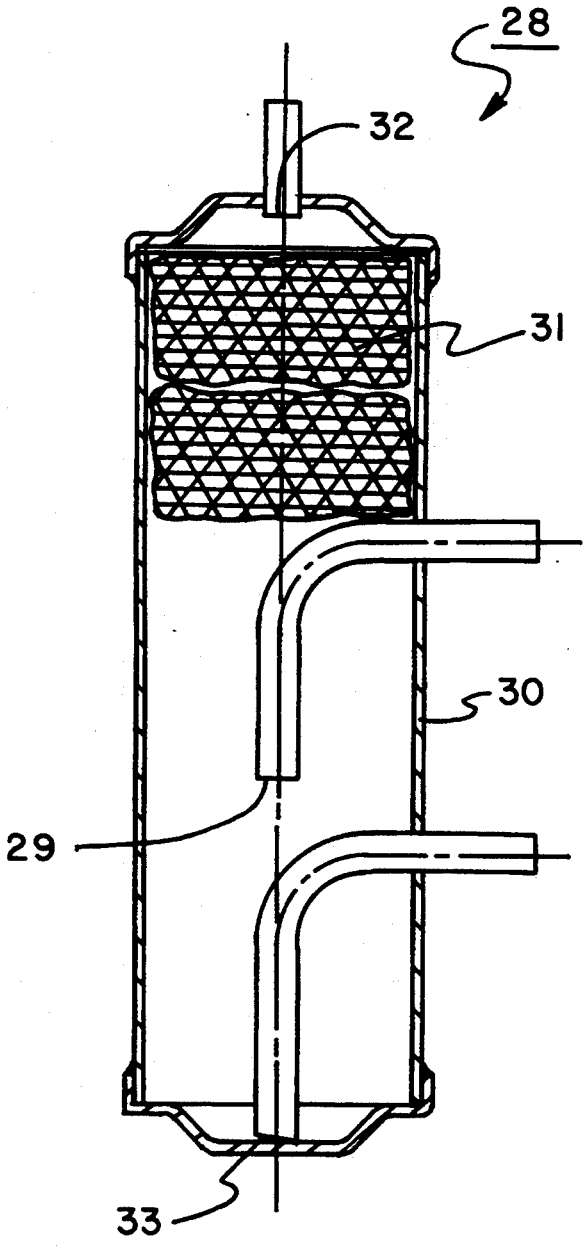
FIG. 4 is a sectional drawing of a second stage oil removal element of a refrigerant purification and recovery apparatus comprising a preferred embodiment of the present invention.

From outlet 23 of first oil separator 22, gas phase refrigerant flows into second stage oil removal element 28 through inlet 29. As best seen in FIG. 4, second stage oil separator 28 includes second separator canister 30 and porous plug 31, which is preferably fabricated of heat conductive material, for example, a pad of copper plated steel mesh material. The gaseous refrigerant must flow through plug 31 to escape canister 30 through outlet port 32 such that oil entrained in the gaseous refrigerant flow will coalesce on the plug material surface and flow to the bottom of canister 30.

Oil outlets 27, 33 are provided at the bottom of canisters 25 and 30, respectively, to allow accumulated oil to be drained from the canisters from time to time. In the preferred embodiment, canisters 25 and 30 are both drained simultaneously through solenoid valve 34 which opens in response to a signal generated by float sensor 35 when the level of oil accumulated in canister 25 exceeds a predetermined level. Those familiar with the art will recognize that other oil level detection devices, such as photoelectric devices, may be used, and separate detection devices and drain valves might be used for canisters 25, 30. In the exemplary embodiment of recovery and purification apparatus 100, an orifice in the drain line of canister 30 is utilized to provide appropriately proportionate draining of the canisters.

Figure 5:
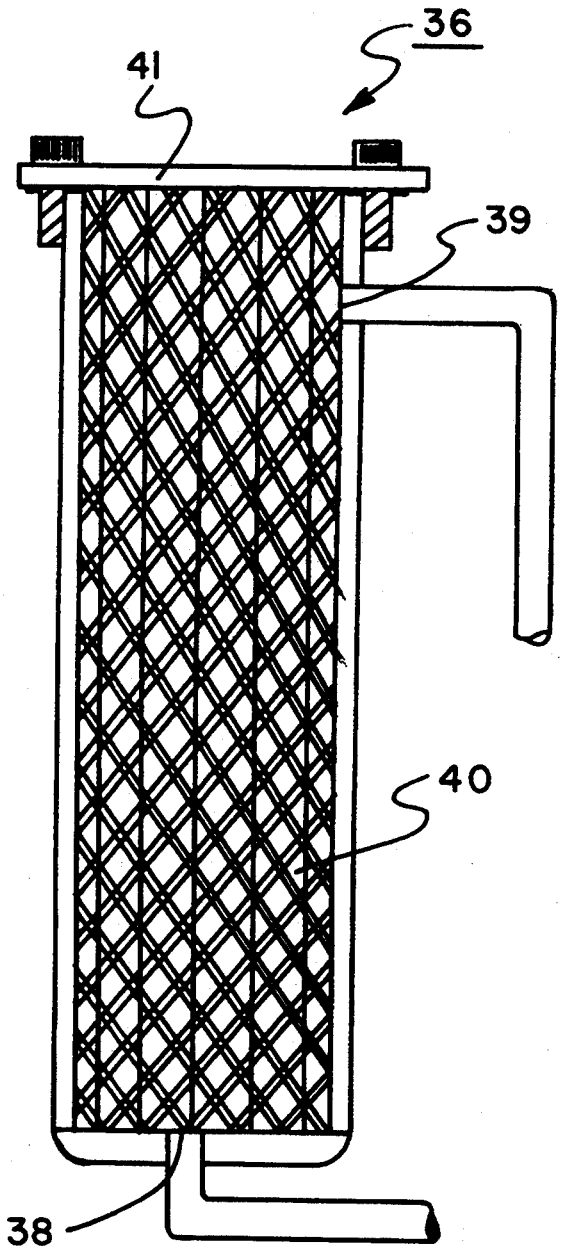
FIG. 5 is a sectional drawing of an oil polisher of a refrigerant purification and recovery apparatus comprising a preferred embodiment of the present invention.

From outlet port 32 of second oil removal element 28 the gas phase refrigerant flows to first oil polisher 36. Oil polisher 36 is shown in section in FIG. 5, and comprises canister 37 having inlet port 38 and outlet port 39 and filled with porous oleophilic element 40 such that refrigerant must pass through element 40 to flow from inlet port 38 to outlet port 39. Oleophilic element 40 may be formed of any appropriate oleophilic sorbent material such as an oil adsorbent material such as those known in the oil and hazardous waste control industries, for example, imbiber beads, foam or fibrous oil sorbent material such as polypropelyn. Element 40 of oil polisher 36 comprising the exemplary preferred embodiment is formed of a rolled, fibrous polypropelyn matt material. Canister 37 is provided with removable cap 41 to allow removal and replacement of element 40 when its oil sorbing capacity has been depleted.

From oil polisher 36, refrigerant flows through vapor acid filter 42 and conduit 43 to compressor 50. Compressor 50 of the exemplary embodiment of FIG. 1 is similar to compressors known in the refrigeration art which require internal lubricating oil for proper operation. When such compressors are used, oil will generally be entrained into the refrigerant flow during the compression process. Thus, in refrigerant recovery and purification apparatus 100 comprising the exemplary embodiment, after compression, the hot, compressed refrigerant gas is passed through additional oil removal elements—hot-gas oil trap 52 and oil polisher 58.

Figure 6:
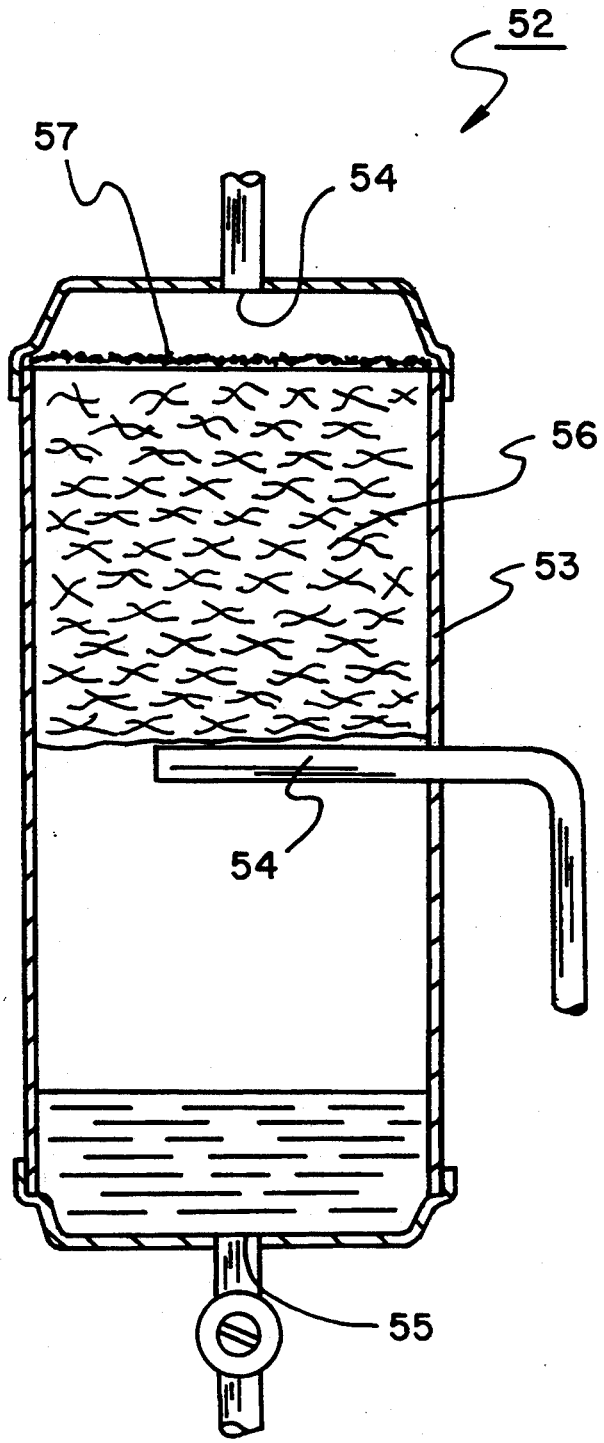
FIG. 6 is a sectional drawing of a hot-gas oil trap of a refrigerant purification and recovery apparatus comprising a preferred embodiment of the present invention.

Hot-gas oil trap 52, which may best be seen in the sectional view of FIG. 6, includes cylindrical canister 53 with fluid entry tube 54 extending through its side wall, exhaust port 54 at its upper end, and drain port 55 at its lower end. Porous plug 56, preferably formed of heat conductive material, for example, woven copper or copper-plated steel, fills an upper portion of the canister such that gas entering the canister through entry tube 54 must flow through the porous material to escape through exhaust port 32. Thus, oil entrained in the gaseous refrigerant will coalesce on the plug material surface and flow to the bottom of canister 53 where it may be drained through drain port 55. In the exemplary embodiment of FIG. 5, plug 56 is confined between inwardly extending entry tube 54 and woven screen 57. A liquid level sensor and valve, such as float valve 59, may be utilized to drain canister 53 when the level of oil accumulated in canister 53 exceeds a predetermined level. After passing through hot-gas oil trap 52, the gaseous refrigerant flows through second oil polisher 58, which is substantially identical to first oil polisher 36.

An additional problem associated with the use of compressors similar to those known in the refrigeration art which require internal lubricating oil for proper operation in a portable refrigerant recovery and purification apparatus is the possibility of lubricant oil flowing from the compressor, upstream, through refrigerant processing conduits, and contaminating refrigerant purification element sorbent and filtration material when the recovery and purification apparatus is tipped from its base during transport between job sites. To minimize the possibility of contamination of upstream purification elements by lubricating oil contained in compressor 50 in the event recovery and purification apparatus 100 is tilted on its base during transport, refrigerant recovery and purification apparatus 100 comprising the exemplary embodiment includes high point 48 in conduit 43. High point 48 is sufficiently high to remain at a greater elevation than the lubricating oil in compressor 50 when refrigerant recovery and purification apparatus 100 is tilted to any expected angle from its intended position of repose upon its base during transport.

After flowing through oil polisher 58, the hot, gaseous refrigerant flows through conduit 60 to a condenser core of evaporator-condenser 16. Conduit 60 includes coil portions of warming elements 15, within separator vessel 6, and 19, within canister 25 of oil removal element 22, over which heat transfer occurs to cool the hot flowing gas and warm refrigerant within vessel 6 and accumulated oil within canister 25. The refrigerant gas is then further cooled by heat transfer to the ambient atmosphere while flowing through a condenser core of evaporator-condenser 16.

Figure 7:
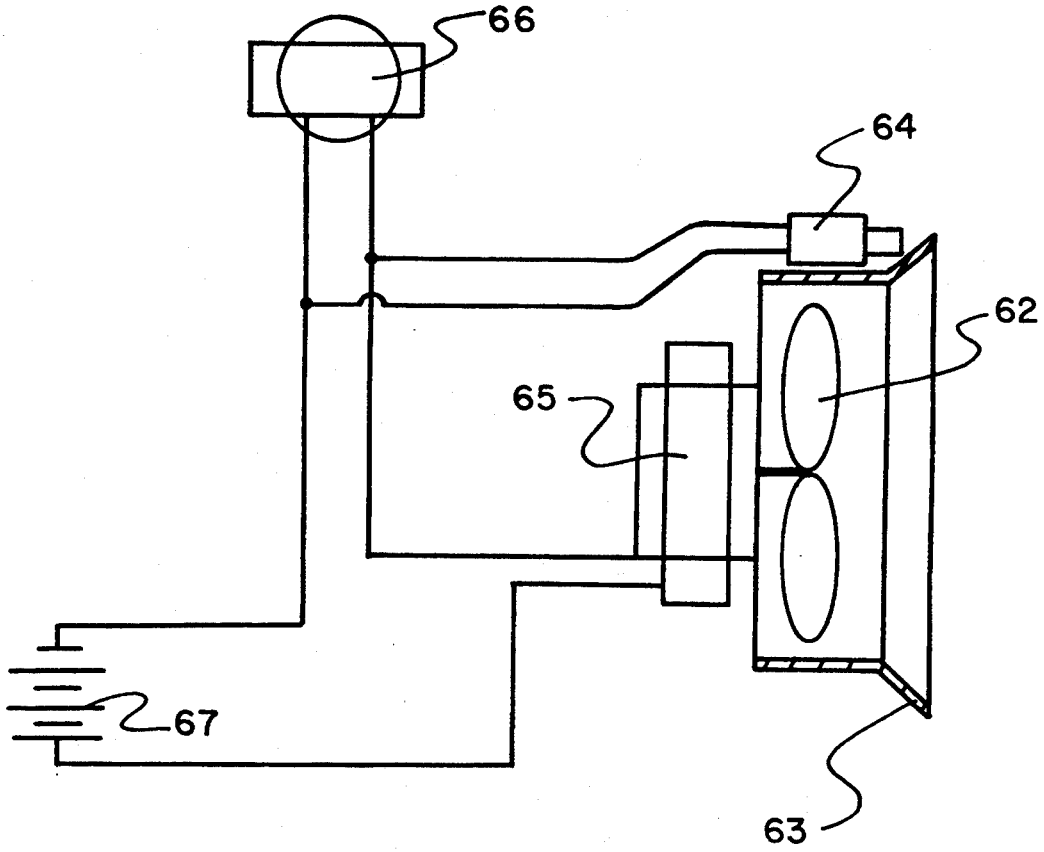
FIG. 7 is a schematic drawing of a power control circuit for a condenser fan of a refrigerant purification and recovery apparatus comprising a preferred embodiment of the present invention.

Cooling of the refrigerant gas in the condenser core of evaporator-condenser 16 is augmented by fan 62 which is controlled by temperature sensing switch 64 and pressure sensing switch 66 of power control circuit 68. Power control circuit 68 is shown in schematic in FIG. 7. Temperature sensing switch 64 and pressure sensing switch 66 are arranged in parallel such that, if either switch is closed, fan motor 65 of fan 62 will be energized. Temperature sensing switch 64 of recovery and purification apparatus 100 comprising the exemplary preferred embodiment is mounted on fan shroud 63 within a cabinet housing refrigerant recovery and purification apparatus 100 and assumes a closed position when the temperature sensed is above a threshold temperature which is dependent upon whether fan motor 65 is energized or not energized. Thus, for example, when pressure sensing switch 66 is open, temperature sensing switch 64 will close and motor 65 will become energized when the temperature sensed by temperature sensing switch 64 rises through 70 degrees fahrenheit and, once motor 65 is energized, temperature sensing switch 64 will open the circuit to stop the fan when the temperature sensed by temperature sensing switch 64 falls through 45 degrees fahrenheit. Similarly, pressure sensing switch 66 senses a pressure downstream of temperature expansion valve 14 and assumes a closed position when the pressure sensed is above a threshold pressure which is dependent upon whether fan motor 65 is energized. Thus, for example, when temperature sensing switch 64 is open, pressure sensing switch 66 will close and motor 65 will become energized when the pressure sensed by pressure sensing switch 66 rises through 225 psi and, once motor 65 is energized, pressure sensing switch 66 will open the circuit to stop the fan when the pressure sensed by pressure sensing switch 66 falls through 200 psi. As the switches are arranged in parallel, the fan will operate when either the temperature or pressure based energizing criteria is met. In recovery and purification apparatus 100 comprising the exemplary preferred embodiment, fan 62 is arranged to blow atmospheric gas over the heat exchange surface of the evaporator core before it passes over the heat exchange surface of the condenser core to increase cooling effectiveness of the condenser core.

After cooling in the condenser core, the refrigerant flows to receiver-separator vessel 72 for purging of noncompressible gas contaminates as is described in detail in U.S. Pat. No. 5,078,756. From receiver-separator vessel 72, the refrigerant, now of substantially liquid phase, flows through liquid moisture filter 74 and particulate filter 76 to outlet 78 which is connected to a refrigerant storage container. Recovery and purification apparatus 100 comprising the exemplary preferred embodiment further includes sight glass 75, which has a moisture sensitive element which changes color to indicate if the purified refrigerant has an excessive moisture content for immediate reuse without further processing, in the final portion of the refrigerant purification course.

Refrigerant recovery and purification apparatus 100 comprising the exemplary preferred embodiment also includes a signal device for indicating when the filtering capacity of the core of filter 74 may be depleted and the core should be replaced. During operation of recovery and purification apparatus 100, control board 80 receives a signal from flow meter 84 indicative of the flow of refrigerant through the purification course. When cumulative flow of refrigerant through the purification course reaches a predetermined amount, after when the filter core of filter 74 may be expected to be depleted, control board 80 causes a signaling device, for example, signaling light 88, to generate a signal indicating that the filter core should be changed. Removal of the cap of the filter canister of filter 74 during replacement of the filter core is sensed by cap removal sensor 86 which transmits a signal to control board 80. Upon receipt of the cap removal signal, control board 80 extinguishes signal light 88 until flow meter 84 measures a subsequent cumulative flow of a predetermined amount.

In the preferred embodiment of FIG. 1, control board 80 selects a predetermined cumulative flow amount which is high or low depending upon the level of contamination of the refrigerant being processed. Control board 80 receives signals generated by float sensor 35 to open solenoid valve 34. If the frequency of signal occurrence is higher than a predetermined frequency, indicating that the expected contamination of the refrigerant is high, a lower predetermined cumulative flow amount is selected. Those familiar with the art will recognize that the flow amount may be selected in a similar manner from any number of predetermined cumulative flow amounts or from a continuous range of cumulative flow amount. Also, board 80 may determine the rate of flow of refrigerant through the purification course from signals generated by flow meter 84, and select a predetermined cumulative flow amount based upon the ratio of the frequency of signals generated by float sensor 35 to the flow rate. By employing a number of sensors and signaling devices, control board 80 can be made to monitor and direct the maintenance of any number of the sorbent and filtration cores employed in purification elements of recovery and purification apparatus 100.

Flow meter 84 of purification apparatus 100 is provided with slip bypass conduit 82 and downstream orifice 87 to protect flow meter 84 from high differential pressures. Those familiar with the art will understand that orifice 87, located downstream of the junction of the downstream end of by pass conduit 82 and meter conduit 87, is sized to limit overall flow through the purification channel in expected high pressure conditions to a level at which meter 84 will properly function. Orifices 81 and 82, located within bypass conduit 82 and meter conduit 87 respectively, are sized and proportioned to allow flow of refrigerant through bypass 82 during the presence of high pressure differentials over meter 84 to extend the range of operation of meter 84 and avoid failure or improper operation of meter 84 over an expected range of operation.

Meter 84 may be releasibly connected to refrigerant purification and recovery apparatus 100, for example, provided with quick connection pressure hoses adapted to be connected to connector 78 and a fitting on a refrigeration storage canister. In such cases, meter 84 may be fitted with a cabinet also containing board 80 and signal device 88. Control board 80 may, in such case, be provided with a releasable electrical connector to receive signals generated by float sensor 35, or could simply cause signal 88 to be energized when a single predetermined cumulative flow amount, or an amount entered by a program input device such as a keyboard, was reached.

Figure 2:
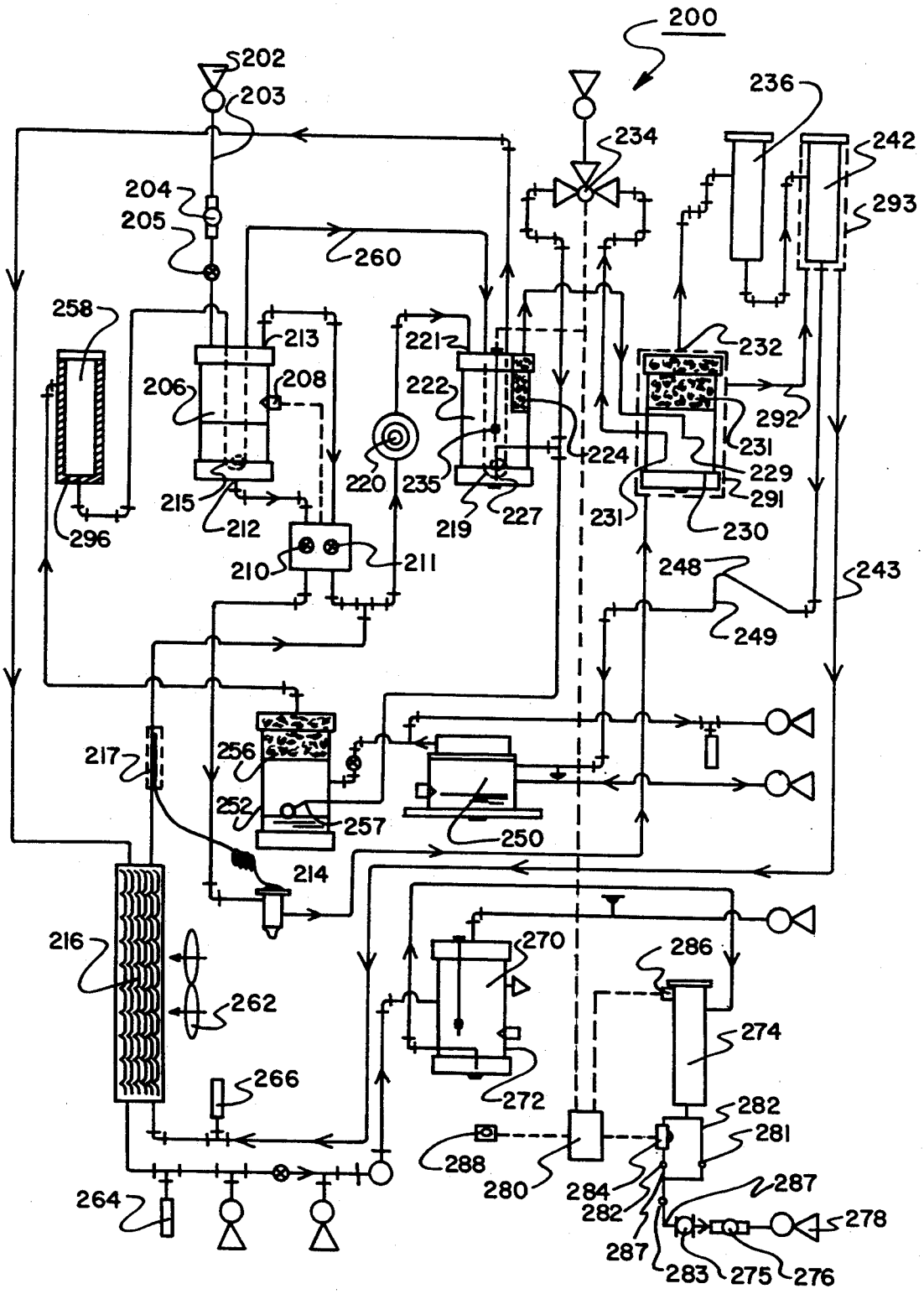
FIG. 2 is a schematic drawing of a refrigerant purification and recovery apparatus comprising an alternative embodiment of the present invention.

Refrigerant recovery and purification apparatus 200 comprising an alternative exemplary embodiment of the present invention is shown in FIG. 2. In that figure, similar reference numbers indicate elements substantially identical to those of the earlier described embodiment. In the alternative embodiment, after the liquid phase refrigerant is throttled through temperature expansion valve 214, it is conducted through first conduit 290 to first fluid jacket 291 surrounding canister 230 of second stage oil separator 228. Thus, heat transfer occurs from refrigerant in the gas purification course within second stage separator 228 to the throttled liquid refrigerant, promoting coalescence of oil in the separator and gasification of the liquid phase refrigerant. From jacket 291, the throttled liquid phase refrigerant flows through second conduit 292 into second fluid jacket 293 surrounding the canister of vapor acid filter 242. Thus, heat transfer occurs from refrigerant in the gas purification course within vapor acid filter 242 to the throttled liquid refrigerant, cooling the gaseous refrigerant and enhancing the performance of acid filter 242 and promoting gasification of the liquid phase refrigerant. From second jacket 293, the liquid phase refrigerant flows through conduit 294 and into the evaporator core of evaporator-condenser 216. Exemplary recovery and purification apparatus 200 comprising the alternative embodiment also includes insulation jacket 296 surrounding the canister of second oil polisher 258 to reduce cooling of hot gaseous refrigerant within the canister and promote oil removal efficiency of polisher 258 by minimizing the possibility of the presence of liquid phase refrigerant within the polisher.

From the above description, it can be seen that the refrigerant purification and recovery method for removing refrigerant from a refrigeration unit and for purifying the refrigerant removed from the refrigeration unit utilized by the present invention includes drawing a stream of fluid refrigerant from the refrigeration unit; separating liquid phase refrigerant from the fluid refrigerant stream; throttling and warming the liquid refrigerant to a substantially gaseous state; reintroducing the substantially gasified liquid refrigerant to the fluid refrigerant stream so that the refrigerant stream is substantially gaseous; bringing the gaseous refrigerant stream into contact with a relatively cool, heat conducting surface to cause oil entrained in the gas to coalesce on the surface; passing the gaseous refrigerant stream through a porous, oleophilic sorbent material; passing the gaseous refrigerant through an acid filter; compressing the gaseous refrigerant stream; bringing the compressed refrigerant stream into contact with a relatively cool, heat conducting surface to cause oil entrained in the refrigerant to coalesce on the surface; passing the compressed refrigerant stream through a porous, oleophilic sorbent material; cooling the compressed refrigerant stream to substantially liquify the refrigerant stream; passing the substantially liquified refrigerant stream through a receiver separator vessel and venting said vessel to remove noncompressible gasses from the stream; passing the liquified refrigerant stream through a liquid moisture filter to remove moisture from the stream; and, passing the liquid refrigerant through a particulate filter.

While exemplary refrigeration purification and recovery apparatus comprising a preferred embodiment of the present invention has been shown, it will be understood, of course, that the invention is not limited to that embodiment. Modification may be made by those skilled in the art, particularly in light of the foregoing teachings. It is, therefore, contemplated by the appended claims to cover any such modification which incorporates the essential features of this invention or which encompasses the spirit and scope of the invention.

We claim:

1. A refrigerant purification and recovery apparatus for removing refrigerant from a refrigeration unit and for purifying the refrigerant removed from the refrigeration unit comprising:

refrigerant phase separation means for dividing a stream of fluid refrigerant into a stream of liquid phase refrigerant and a stream of gaseous phase refrigerant;

refrigerant gasification means for converting a stream of liquid refrigerant into a stream of substantially gaseous refrigerant; and, gaseous refrigerant purification means for purifying a stream of gaseous refrigerant, said gaseous refrigerant purification means including an oil polisher comprising a canister with an entry port through which refrigerant can enter the canister and an exit port through which refrigerant can exit the canister and a porous, oleophilic, oil adsorbent material contained within the canister such that refrigerant must pass through the oil adsorbent material to pass from said entry port to said exit port.

2. A refrigerant purification and recovery apparatus as in claim 1 in which said sorbent material comprises oleophilic beads.

3. A refrigerant purification and recovery apparatus as in claim 1 in which said sorbent material is a fibrous material.

4. A refrigerant purification and recovery apparatus as in claim 3 in which said fibrous material is a rolled sheet of material.

5. A refrigerant purification and recovery apparatus as in claim 1 in which said oil polisher canister comprises an inner shell and an outer shell surrounding said inner shell to define a jacket about said sorbent material, said outer shell including a refrigerant inlet and a refrigerant outlet to allow refrigerant flowing through said refrigerant gasification means to flow through said jacket, said inner shell comprising a heat conducting material such that heat transfer may occur between fluid contained in said jacket and fluid contained in said inner shell.

6. A refrigerant purification and recovery apparatus for removing refrigerant from a refrigeration unit and for purifying the refrigerant removed from the refrigeration unit comprising:

refrigerant phase separation means for dividing a stream of fluid refrigerant into a stream of liquid phase refrigerant and a stream of gaseous phase refrigerant;

refrigerant gasification means for converting a stream of liquid refrigerant into a stream of substantially gaseous refrigerant; and, gaseous refrigerant purification means for purifying a stream of gaseous refrigerant, said gaseous refrigerant purification means including an acid filter, said acid filter including a filter core within a canister through which refrigerant flowing through said gaseous refrigerant purification means flows and said refrigerant gasification means includes a jacket surrounding said canister through which refrigerant flowing through said refrigerant gasification means flows.

7. A refrigerant purification and recovery method for removing refrigerant from a refrigeration unit and for purifying the refrigerant removed from the refrigeration unit comprising:

A. drawing fluid refrigerant from the refrigeration unit;

B. differentiating between liquid and gaseous refrigerant;

C. throttling and warming the liquid refrigerant to substantially gasefy it;

D. bringing the gaseous refrigerant into contact with a relatively cool, heat conducting surface to cause oil entrained in the gaseous refrigerant to coalesce; and, E. passing the gaseous refrigerant through a porous, oleophilic oil-adsorbent material.

8. The method of claim 7 comprising the additional steps of:

F. passing the gaseous refrigerant through an acid filter;

G. compressing the gaseous refrigerant;

H. cooling the refrigerant until it is in a substantially liquid phase;

I. passing the liquified refrigerant through a filter to remove moisture; and,

J. passing the liquified refrigerant through a particulate filter.

9. A refrigerant purification and recovery method for removing refrigerant from a refrigeration unit and for purifying the refrigerant removed from the refrigeration unit comprising:

A. drawing a stream of fluid refrigerant from the refrigeration unit;

B. separating liquid refrigerant from the fluid refrigerant stream;

C. throttling and warming the liquid refrigerant to a substantially gaseous state;

D. reintroducing the substantially gasified liquid refrigerant to the fluid refrigerant stream so that the stream is substantially gaseous;

E. bringing the gaseous refrigerant stream into contact with a relatively cool, heat conducting surface to cause oil entrained in the gas to coalesce on the surface;

F. passing the gaseous refrigerant stream through a porous, oleophilic sorbent material;

G. passing the gaseous refrigerant stream through an acid filter;

H. compressing the gaseous refrigerant stream;

I. bringing the compressed refrigerant stream into contact with a relatively cool, heat conducting surface to cause oil entrained in the refrigerant to coalesce on the surface;

J. passing the compressed refrigerant stream through a porous, oleophilic sorbent material;

K. cooling the compressed refrigerant stream to substantially liquify the refrigerant stream;

L. passing the liquified refrigerant stream through a receiver separator vessel and venting the vessel to remove noncompressible gasses from the stream;

M. passing the liquified refrigerant stream through a liquid moisture filter to remove moisture from the stream; and, N. passing the liquid refrigerant through a particulate filter.

* * * * *